US012473829B1

(12) United States Patent
Sollami

(10) Patent No.: US 12,473,829 B1
(45) **Date of Patent: *Nov. 18, 2025**

(54) BIT HOLDER WITH SLOTTED SHANK AND ANNULAR RING

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 389 days.

This patent is subject to a terminal disclaimer.

(21) Appl. No.: 17/877,084

(22) Filed: Jul. 29, 2022

Related U.S. Application Data

(63) Continuation-in-part of application No. 17/146,992, filed on Jan. 12, 2021, now Pat. No. 11,891,895.

(51) Int. Cl.
*E21C 35/197* (2006.01)

(52) U.S. Cl.
CPC ..... *E21C 35/197* (2013.01)

(58) Field of Classification Search
CPC .... E21C 35/191; E21C 35/197; E21C 35/188; E21C 35/19
See application file for complete search history.

(56) References Cited

U.S. PATENT DOCUMENTS

| | | | | |
|---|---|---|---|---|
| 5,628,549 | A * | 5/1997 | Ritchey | E21C 35/197 299/107 |
| 6,099,081 | A * | 8/2000 | Warren | E21C 35/197 299/85.2 |
| 6,786,557 | B2 * | 9/2004 | Montgomery, Jr. | E21C 35/197 411/520 |
| 10,385,689 | B1 * | 8/2019 | Sollami | E21C 35/18 |
| 2012/0068527 | A1 * | 3/2012 | Erdmann | B28D 1/188 299/106 |
| 2013/0169023 | A1 * | 7/2013 | Monyak | E21C 35/197 299/104 |
| 2016/0194956 | A1 * | 7/2016 | Sollami | B28D 1/188 299/113 |
| 2018/0003050 | A1 * | 1/2018 | Sollami | E21C 35/18 |

* cited by examiner

*Primary Examiner* — Janine M Kreck
(74) *Attorney, Agent, or Firm* — Mercedes V. O'Connor; Rockman Videbeck & O'Connor

(57) ABSTRACT

A bit holder that includes a forward body portion and a shank axially depending from the bottom of the forward body portion. The shank of the bit holder includes at least one slot and an annular ring disposed partially or nearly circumferentially around the shank. The slotted shank of the bit holder and the annular ring are radially compressible when inserted into a bore of a base block. An outer diameter of the annular ring being greater than an outer diameter of the shank such that only the outer diameter of the annular ring makes contact with the bore of the base block to achieve and maintain an interference fit when the bit holder is inserted into the bore of the base block.

26 Claims, 8 Drawing Sheets

SECTION E-E

SECTION F-F

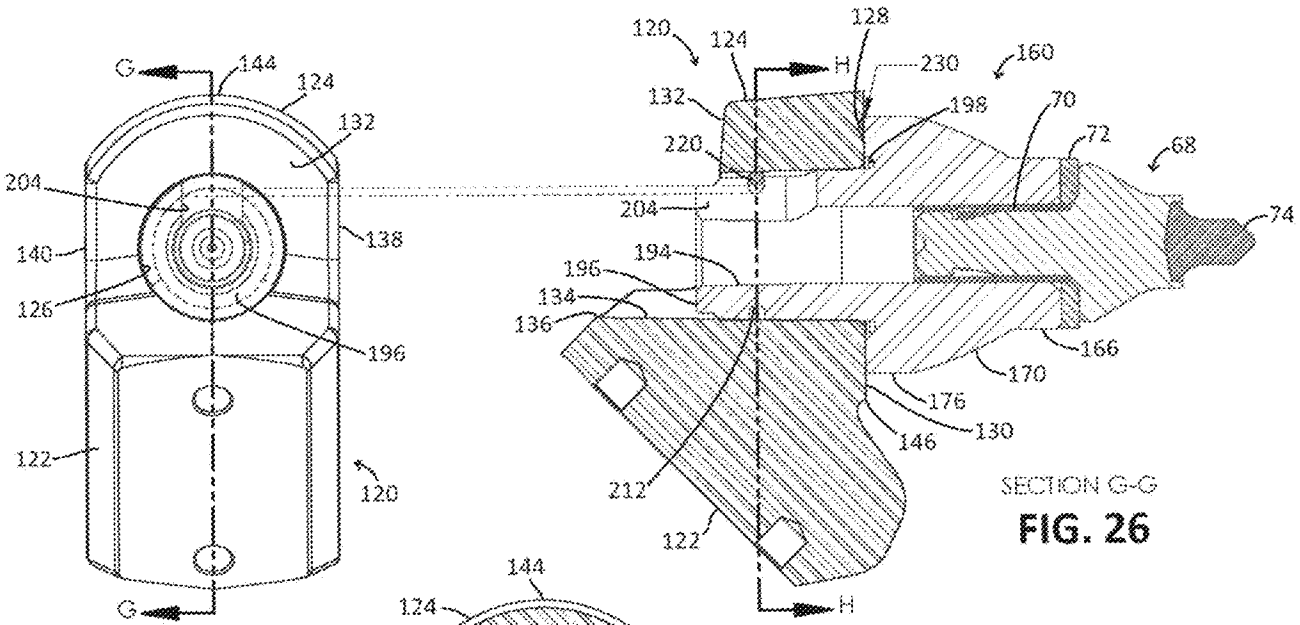
FIG. 26
FIG. 25
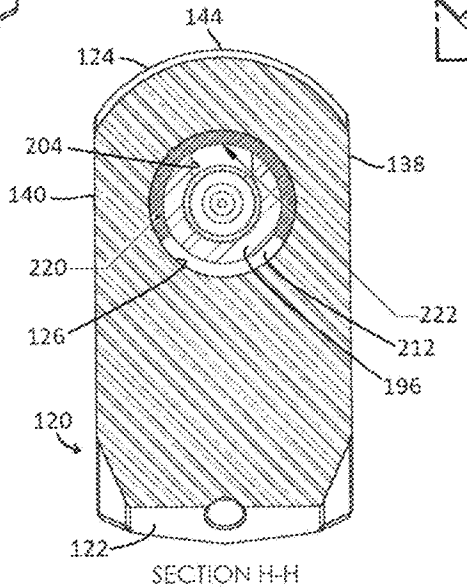
FIG. 27

BIT HOLDER WITH SLOTTED SHANK AND ANNULAR RING

CROSS-REFERENCE TO RELATED APPLICATION(S)

This application claims priority to and is a continuation-in-part of U.S. Non-provisional application Ser. No. 17/146,992, filed Jan. 12, 2021, to the extent allowed by law and the contents of which are incorporated herein by reference in their entireties. The contents of Applicant's U.S. Pat. No. 9,879,531, issued Jan. 30, 2018, U.S. Pat. No. 10,683,752, issued Jun. 16, 2020, U.S. Pat. No. 10,370,966, issued Aug. 6, 2019, and U.S. Pat. No. 11,339,656, issued May 24, 2022, are incorporated herein by reference in their entireties

TECHNICAL FIELD

This disclosure relates to bit assemblies for road milling, mining and trenching machines and, more particularly, to bit holders with a slotted shank and an annular ring.

BACKGROUND

Road milling, mining, and trenching equipment utilizes bits and/or picks traditionally set in a bit assembly. Bit assemblies can include a bit and/or pick retained within a bore in a base block. Bit assemblies can also include a bit and/or pick retained by a bit holder and the bit holder retained within a bore in a bit holder block or base block. A plurality of the bit assemblies are mounted on the outside of a rotatable drum, typically in a V-shaped or spiral configuration. A plurality of the bit assemblies can also be mounted on an endless chain and plate configurations. The combinations of bit assemblies have been utilized to remove material from the terra *firma*, such as degrading the surface of the earth, minerals, cement, concrete, macadam or asphalt pavement. Individual bits and/or picks, bit holders, and base blocks may wear down or break over time due to the harsh road degrading environment. Additionally, the forces and vibrations exerted on the bit assemblies may cause the bit holder to wear away the bore in the base block. As a result, the diameter of the bore of the base block increases over time, decreasing the interference contact between the bit holder shank and the bore of the base block causing the nose of the bit holder to tilt or sag downwardly and/or axially producing a significant downward tilt of the bit holder when the bit holder's wide slot in the bit holder shank is radially positioned nearly centrally with the vertical axis of the base block because the bit holder has no support at the location where the bit holder shank slot meets the device receiving portion of the base block due to the removal of material from the bit holder shank in order to provide the shank with a wider slot, thereby requiring replacement of the bit holder or base block long before the standard minimum lifetime required by the industry.

To prolong the life of the bit assembly, and the bit holder and/or the base block, a bit holder comprising a greater width slotted shank and an annular ring partially or nearly circumferentially disposed around the shank is provided to form and maintain the interference contact between the bore of the base block initially and even as the diameter of the bore of the base block increases from use, thereby preventing downward tilt of the bit holder while in use in the base block. The service life of the bit holder and base block are substantially increased due to the bore wear compensation and prevention of downward tilt provided by the annular ring that acts as a solid and causes the droop of the bit holder to be very minimal.

SUMMARY

This disclosure relates generally to bit assemblies for road milling, mining, and trenching equipment. One implementation of the teachings herein is a bit holder that includes a body portion; a generally cylindrical hollow shank axially depending from a bottom of the body portion, the shank including an annular groove adjacent a distal end of the shank; and an annular ring disposed at least one of partially circumferentially and nearly circumferentially in the annular groove.

In another implementations of the teachings herein is a combination bit holder and base block that includes a base block including a base mounting portion including a base surface; and a device receiving portion integrally extending from the base mounting portion opposite the base surface, the device receiving portion comprising a bore extending from a front face of the device receiving portion to a rear face of the device receiving portion; and a bit holder that includes a body portion; a generally cylindrical hollow shank axially depending from a bottom of the body portion, the shank including an annular groove adjacent a distal end of the shank; and an annular ring disposed at least one of partially circumferentially and nearly circumferentially in the annular groove.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

FIG. 25 is a rear elevation view of the first embodiment of the bit assembly including the prior art bit mounted in the first embodiment of the bit holder that is mounted in the first embodiment of the base block, showing invisible internal elements in dotted lines, in accordance with implementations of this disclosure;

FIG. 26 is a cross-sectional view of the first embodiment of the bit assembly, taken along Line G-G of FIG. 25, showing the prior art bit mounted in the first embodiment of the bit holder, shown with the first embodiment of the metal ring disposed on the shank of the bit holder, that is mounted in the first embodiment of the base block in accordance with implementations of this disclosure; and FIG. 27 is a cross-sectional view of the first embodiment of the bit assembly, taken along Line H-H of FIG. 26, showing the prior art bit mounted in the first embodiment of the bit holder, shown with the first embodiment of the metal ring disposed on the shank of the bit holder, that is mounted in the first embodiment of the base block, in accordance with implementations of this disclosure.

DETAILED DESCRIPTION

Figure 1:
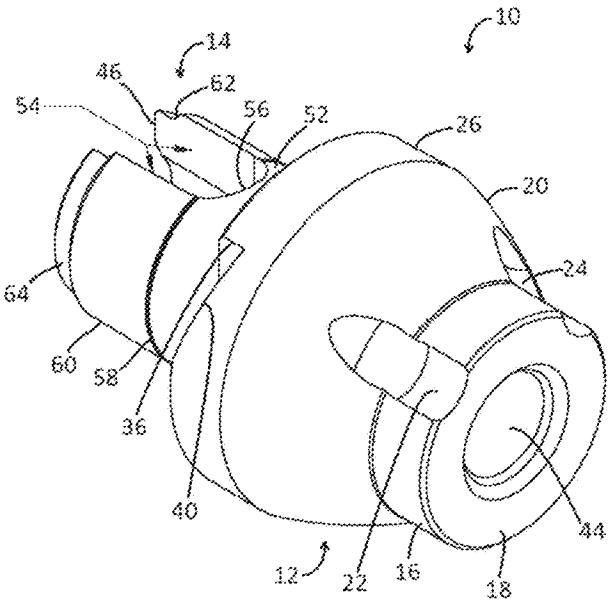
PRIOR ART FIG. 1
FIG. 1 is a front perspective view of a prior art bit holder.

Road milling, mining, and trenching equipment utilizes bits and/or picks traditionally set in a bit assembly. Bit assemblies can include a bit and/or pick retained within a bore in a base block. Bit assemblies can also include a bit and/or pick retained by a bit holder and the bit holder retained within a bore in a bit holder block or base block. A plurality of the bit assemblies are mounted on the outside of a rotatable drum, typically in a V-shaped or spiral configuration. A plurality of the bit assemblies can also be mounted on an endless chain and plate configurations. The combinations of bit assemblies have been utilized to remove material from the terra *firma*, such as degrading the surface of the earth, minerals, cement, concrete, macadam or asphalt pavement. Individual bits and/or picks, bit holders, and base blocks may wear down or break over time due to the harsh road degrading environment. Additionally, the forces and vibrations exerted on the bit assemblies may cause the bit holder to wear away the bore in the base block. As a result, the diameter of the bore of the base block increases over time, decreasing the interference contact between the bit holder and the bore of the base block, causing the nose of the bit holder to tilt or sag downwardly and/or axially producing a significant downward tilt of the bit holder when the bit holder's wide slot in the bit holder shank is radially positioned nearly centrally with the vertical axis of the base block because the bit holder has no support at the location where the bit holder shank slot meets the device receiving portion of the base block due to the removal of material from the bit holder shank in order to provide the shank with a slot, thereby requiring replacement of the bit holder or base block long before the standard minimum lifetime required by the industry.

Typically, the slot removes approximately less than 50% of the bit holder shank. For example, a slot that removes 40% of the shank causes considerable drooping of the nose of the bit holder. To reduce drooping and prolong the life of the bit assembly, and the bit holder and/or the base block, a bit holder comprising a slotted shank and an annular ring partially or nearly circumferentially disposed around the shank is provided to form and maintain the radial interference contact between the bore of the base block initially and even as the diameter of the bore of the base block increases from use, thereby preventing downward tilt of the bit holder while in use in the base block. To achieve reduced drooping, the slot, in one exemplary illustrated implementation, comprises a ⅝ inch width that reduces drooping and only allows up to an approximate ⅛ inch of separation between the bottom of the bit holder body and a front face of the device receiving portion of the base block. The service life of the bit holder and base block are substantially increased due to the bore wear compensation and prevention of downward tilt provided by the annular ring that acts as a solid and causes the droop of the bit holder to be very minimal or totally eliminated.

Figure 2:
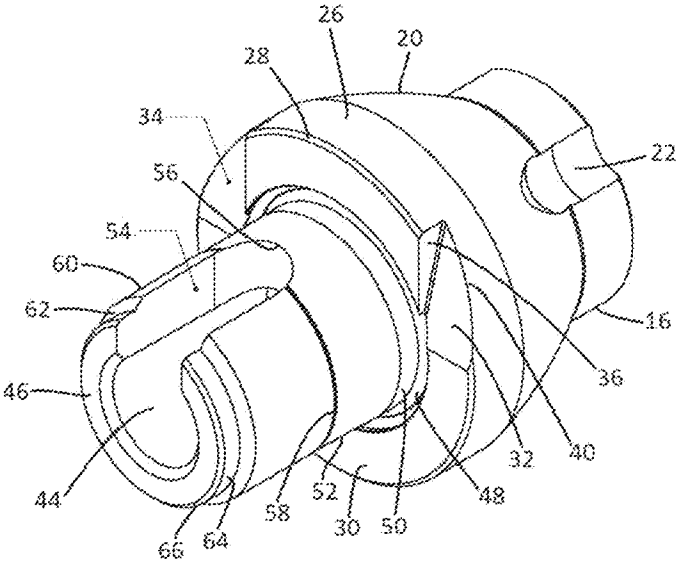
PRIOR ART FIG. 2
FIG. 2 is a rear perspective view of the prior art bit holder.

A prior art bit holder 10, shown in FIGS. 1-8, includes a bit holder body 12 and a generally cylindrical hollow shank 14 axially depending from a bottom of the bit holder body 12. The bit holder body 12 is generally annular in shape and includes a generally cylindrical upper body portion 16 axially extending from a flat annular top surface 18. Subjacent the upper body portion 16 is an arcuate or convex mediate portion 20 that extends to a generally cylindrical tire portion 26 axially extending from the mediate portion 20. A chamfer 28 (FIG. 2) extends from a bottom of the tire portion 26 to a flat, generally annular back flange 30. A pair of notches 22, 24, shown in FIGS. 1 and 2, are formed into the bit holder body 12 and extend from the flat annular top surface 18 through the upper body portion 16, terminating at a point just within the mediate portion 20.

The back flange 30 includes a pair of horizontal tapered cutouts 32, 34 (FIGS. 1, 2, 5, and 8) generally perpendicular to the longitudinal axis of the bit holder 10, one on either side of the back flange 30. The tapered cutouts 32, 34 each include a flat vertical inside surface 36, 38, respectively, that are parallel with each other and a flat tapered top surface 40, 42, respectively.

The shank 14 includes an elongate slot 54 extending from a generally annular distal end 46 of the shank 14 axially upward or forward to an upper termination 56 near the upper or forward end of the shank 14. A central bore 44 axially extends from the top surface 18 of the bit holder 10 to the distal end 46 of the shank 14.

Depending from the back flange 30 of the bit holder body 12 is the generally cylindrical hollow shank 14. The top portion of the shank 14 includes a rounded junction 48 (FIG. 2) between the bit holder body 12 and the shank 14 of the bit holder 10. An increased diameter first segment 50 axially depends from the bottom of the bit holder body 12 adjacent a decreased diameter tapered second segment 52. An annular shoulder 58 axially extends from the first segment 50 to the second segment 52, the annular shoulder 58 decreasing, or stepping down, as it axially extends from the second segment 52 to an increased diameter outwardly tapered third segment 60. The third segment 60 axially extends to a stepped shoulder 62 disposed between the third segment 60 and a decreased diameter generally cylindrical fourth segment 64. The stepped shoulder 62 decreases, or steps down, as it axially extends from the increased diameter outwardly tapered third segment 60 to the decreased diameter generally cylindrical fourth segment 64. A chamfer 66 is disposed between the fourth segment 64 and the distal end 46 of the shank 14, the chamfer 66 decreasing, or taking a step down, as it axially extends from the fourth segment 64 to the distal end 46.

A prior art base block 80, shown in FIGS. 3-5 and 22-24, includes a base surface 82 and a shortened front end or shortened device receiving portion 84 extending outwardly from the base surface 82 that includes a central nominal 1½ inch diameter annular or generally cylindrical base block bore 86 positioned therethrough that axially extends from a front face 90 to a rear face 94 of the shortened front end 84. The base block 80 includes added space behind the device receiving portion 84. This added space provides additional access up to about ⅞ inch from the device receiving portion 106 for tools to remove or punch out either bits from the bit holder 10 annular or circular bore 44 or the bit holder 10 from the base block bore 86.

The shortened front end 84 includes an indentation 88 (FIG. 23) on the front face 90 of the base block 80. The shortened front end 84 also includes a slot 92 (FIGS. 4 and 22-24) decreasing in radial size from the rear face 94 of the shortened front end 84 to a position mediate the front face 90. The slot 92 provides added room for a punch (not shown) to operate and push the shank of a bit out of the bit holder.

The base block 80 also includes an extension of an arcuate segment 96 of the base block bore 86 (FIGS. 4 and 23) starting at an inner portion of the base block bore 86 adjacent the rear face 94 of the shortened front end 84 and extending toward a rear 98 (FIGS. 4, 5, and 23) of the base block 80.

The shortened front end 84 also includes a pair of flat vertical sides 100, 102 (FIGS. 3, 5, 22, and 24) that extend near and/or adjacent to the base surface 82. The flat vertical sides 100, 102 reduce the dimensions of the base block 80 width and allow bit assemblies to be positioned in closer center-to-center axial bit tip orientation in order to degrade the road to a smoother surface. A vertical distance between a top portion 106 and a bottom portion 108 of the shortened front end 84 is greater than a horizontal distance between the flat vertical sides 100, 102 of the shortened front end 84.

Figure 4:
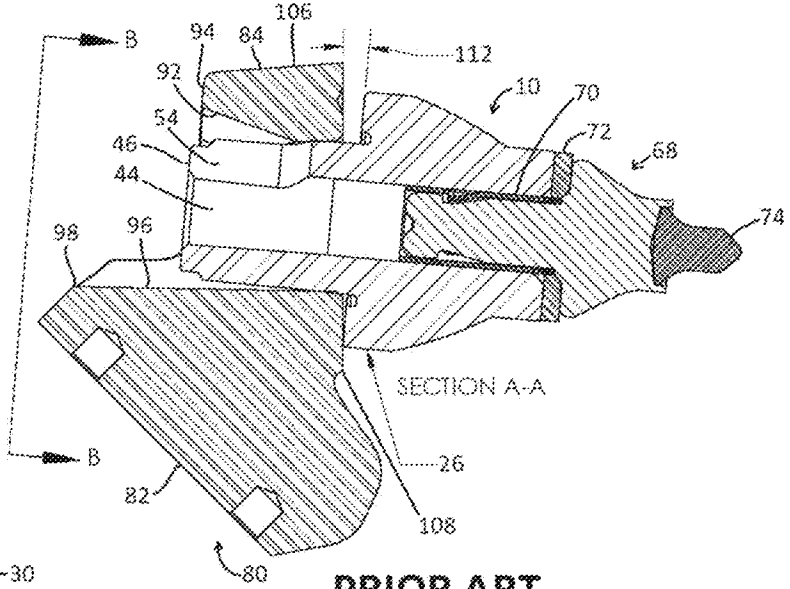
PRIOR ART FIG. 4
FIG. 4 is a cross-sectional view of the prior art bit assembly, taken at Line A-A of FIG. 3, showing the prior art bit, the prior art bit holder, and the prior art base block.
Figure 5:
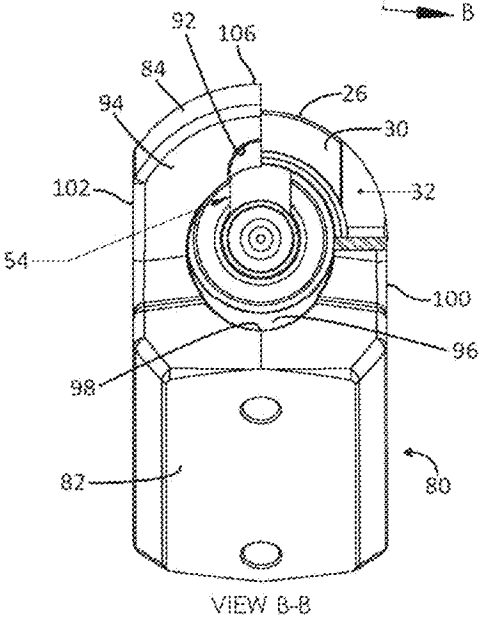
PRIOR ART FIG. 5
FIG. 5 is a rear elevation view of the prior art bit assembly, taken at Line B-B of FIG. 4, showing the prior art bit mounted in the prior art bit holder that is mounted in the prior art base block, the prior art base block shown with the right upper quarter of a device receiving portion cut-out to reveal the bottom of the body of the prior art bit holder.
Figure 3:
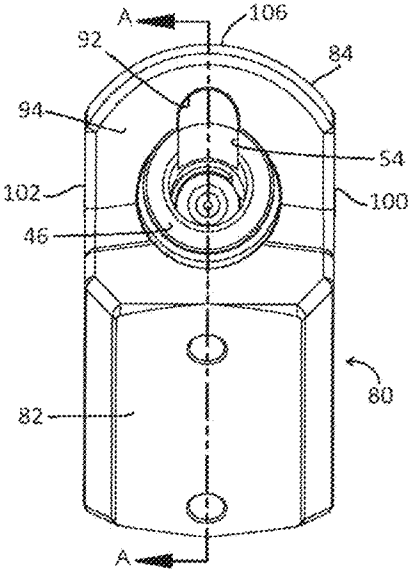
PRIOR ART FIG. 3
FIG. 3 is a rear elevation view of a prior art bit assembly, showing a prior art bit mounted in the prior art bit holder that is mounted in a prior art base block.

To assemble the bit holder 10 in the base block 80, the bit holder shank 14 is inserted into the base block bore 86 such that the slot 54 is radially positioned nearly centrally with the vertical axis of the base block 80. The width of slot 54 of the shank 14 causes the forward end or nose of the bit holder 10 to droop (downward tilt 112) almost immediately after the bit holder shank 14 has been mounted in the base block bore 86, also causing the back flange 30 of the bit holder body 12 of the bit holder 10 to separate from the front face 90 of the device receiving portion 84 of the base block 80, as shown in FIG. 4, and preventing the back flange 30 of the bit holder body 12 from seating onto the front face 90 of the device receiving portion 84 of the base block 80 once the bit holder 10 is fully mounted into the base block bore 86 of the base block 80. The downward tilt 112 of the nose of the bit holder 10 is tied to the width of the slot 54 of the shank 14. The wider the width of the slot 54, the more significant the downward tilt 112 will be. For example, a slot with a ¼ inch width causes the nose of the bit holder 10 to droop causing a downward tilt of about 1/32 inch, whereas a slot with a ⅝ inch width causes the nose of the bit holder to droop causing a downward tilt of about ⅛ inch. Thereafter, the forces generated by impact during use cause further separation of the bottom of the bit holder body 12 from the front face 90 of the device receiving portion 84 of the base block 80, increasing the downward tilt 112 and reducing the lifetime of the bit holder 10, base block 80, and drum. Therefore, a need has developed to prevent the downward tilt of the bit holder and separation of the bottom of the bit holder body from the front face of the device receiving portion of the base block.

Referring to FIGS. 6-8, 19-21, and 25-27, a first embodiment of a base block 120 is shown. Base block 120 includes a base surface 122 which may be flat or slightly concave to fit a drum or additional mounting plates thereon (not shown) on which a plurality of base blocks may be mounted, usually in chevron or spiral fashion. Outwardly of the mounting portion or base surface 122 of the base block 120 is a generally annular shortened front end or bit holder mounting portion 124, also called a device receiving portion or front end, having a central nominal 1½ inch diameter annular or generally cylindrical bore 126 positioned therethrough, which is generally positioned, in this illustrated embodiment, at between 30-60 degrees from the horizontal. The base block bore 126 axially extends from a front face 130 to a rear face 132 of the device receiving portion 126 and includes, in this illustrated exemplary implementation, a one degree taper per side that tapers inwardly towards the centerline of the distal end of the base block bore 126.

The base block 120 includes added space behind the device receiving portion 124. This added space provides additional access up to about ⅞ inch from the device receiving portion 124 for tools to remove or punch out either bits from the bit holder 160 annular or circular bore 194 of the bit holder 160 from the base block bore 126. The base block 120 includes a surface opposite the base surface 122 that extends past the rear face 132 of the device receiving portion 124, the surface including an extension of an arcuate segment 134 of the base block bore 126.

Figure 7:
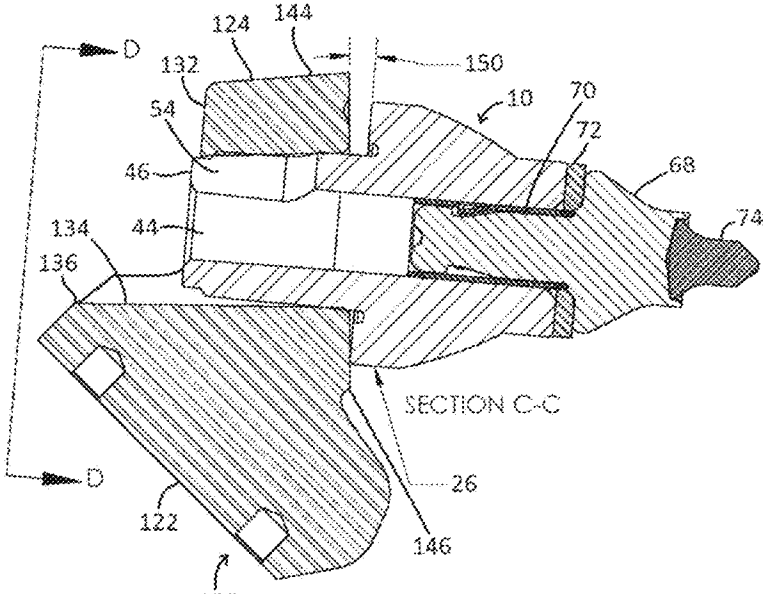
PRIOR ART FIG. 7
FIG. 7 is a cross-sectional view of the bit assembly, taken at Line C-C of FIG. 6, showing the prior art bit, the prior art bit holder, and the first embodiment of the base block, in accordance with implementations of this disclosure.
Figure 8:
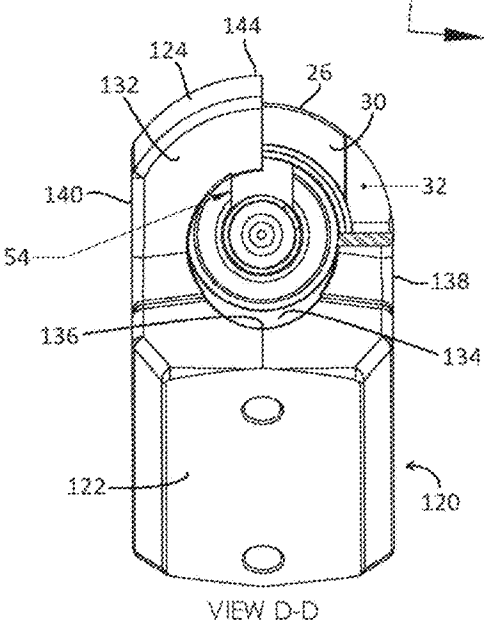
PRIOR ART FIG. 8
FIG. 8 is a rear elevation view of the bit assembly, taken at Line D-D of FIG. 7, showing the prior art bit mounted in the prior art bit holder that is mounted in the first embodiment of the base block, the first embodiment of the base block shown with the right upper quarter of a device receiving portion cut-out to reveal the bottom of the body of the prior art bit holder, in accordance with implementations of this disclosure.
Figure 6:
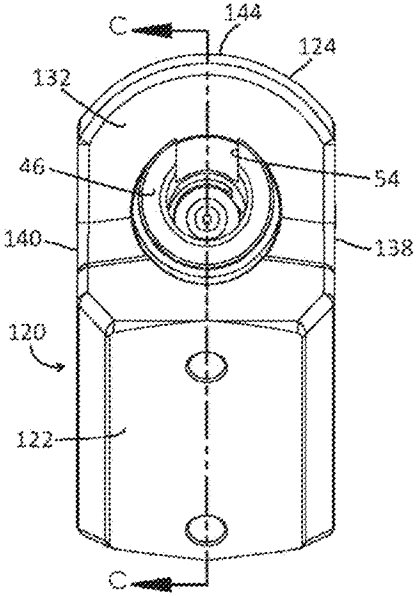
PRIOR ART FIG. 6
FIG. 6 is a rear elevation view of a bit assembly including the prior art bit mounted in the prior art bit holder that is mounted in a first embodiment of a base block in accordance with implementations of this disclosure.
Figure 9:
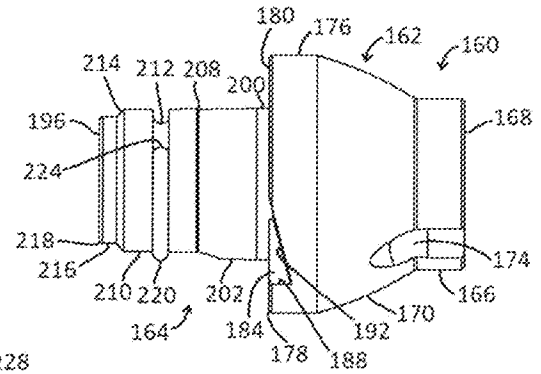
FIG. 9 is a left side elevation view of a first embodiment of a bit holder, shown with a first embodiment of a metal ring disposed on the shank of the bit holder, in accordance with implementations of this disclosure.
Figure 10:
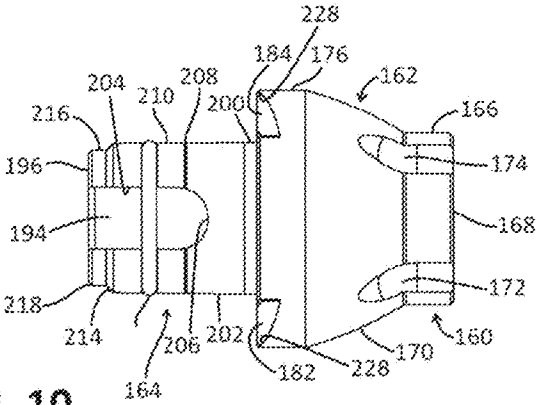
FIG. 10 is a top elevation view of the first embodiment of the bit holder, shown with the first embodiment of the metal ring disposed on the shank of the bit holder, in accordance with implementations of this disclosure.
Figure 11:
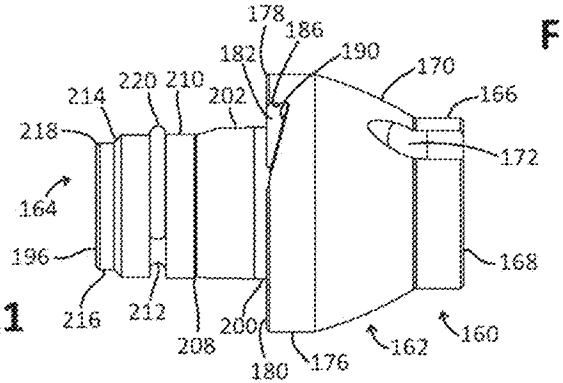
FIG. 11 is a right side elevation view of the first embodiment of the bit holder, shown with the first embodiment of the metal ring disposed on the shank of the bit holder, in accordance with implementations of this disclosure.
Figure 12:
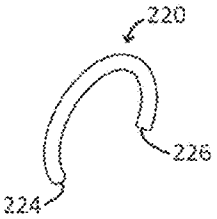
FIG. 12 is a perspective view of the first embodiment of the metal ring in accordance with implementations of this disclosure.
Figure 13:
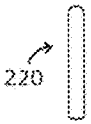
FIG. 13 is a top elevation view of the first embodiment of the metal ring in accordance with implementations of this disclosure.
Figure 14:
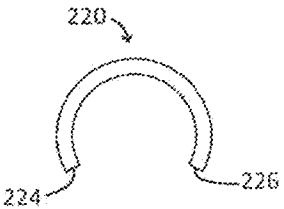
FIG. 14 is aa front elevation view of the first embodiment of the metal ring in accordance with implementations of this disclosure.
Figure 16:
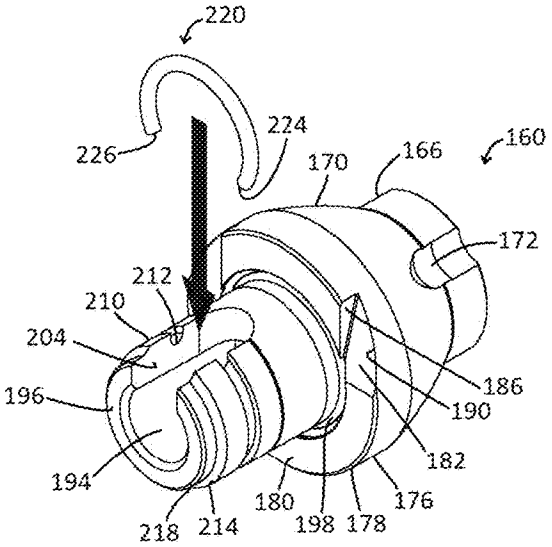
FIG. 16 is a rear perspective view of the first embodiment of the bit holder, shown with the first embodiment of the metal ring prior to assembly with an arrow indicating the direction in which the metal ring must be moved in order to be mounted onto the shank of the bit holder, in accordance with implementations of this disclosure.
Figure 18:
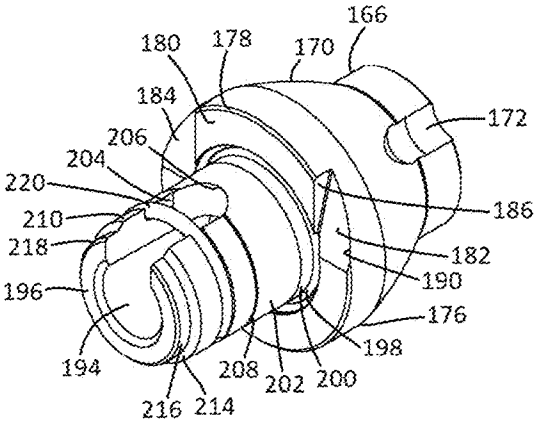
FIG. 18 is a rear perspective view of the first embodiment of the bit holder, shown with the first embodiment of the metal ring disposed on the shank of the bit holder, in accordance with implementations of this disclosure.
Figure 15:
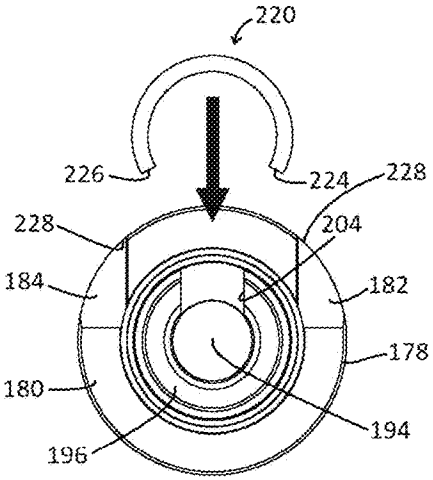
FIG. 15 is a rear elevation view of the first embodiment of the bit holder, shown with the first embodiment of the metal ring prior to assembly with an arrow indicating the direction in which the metal ring must be moved in order to be mounted onto the shank of the bit holder, in accordance with implementations of this disclosure.
Figure 17:
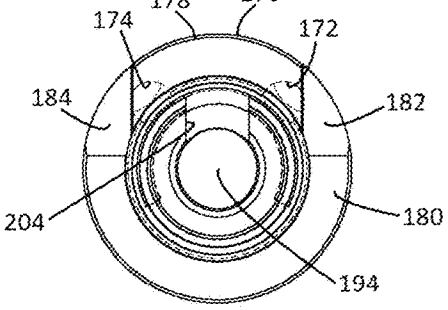
FIG. 17 is a rear elevation view of the first embodiment of the bit holder, shown with the first embodiment of the metal ring disposed on the shank of the bit holder, showing invisible internal elements in dotted lines, in accordance with implementations of this disclosure.
Figure 19:
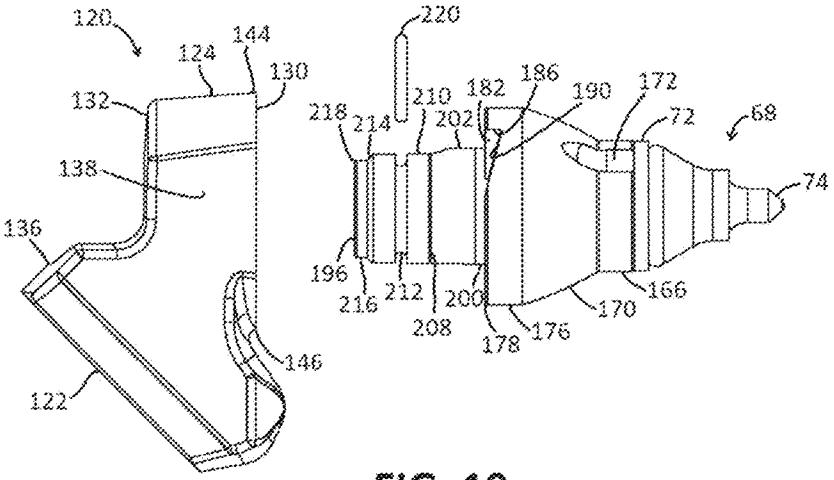
FIG. 19 is an exploded side elevation view of a first embodiment of a bit assembly including the prior art bit mounted in the first embodiment of the bit holder, shown with the first embodiment of the metal ring prior to assembly, and the first embodiment of the base block in accordance with implementations of this disclosure.
Figure 21:
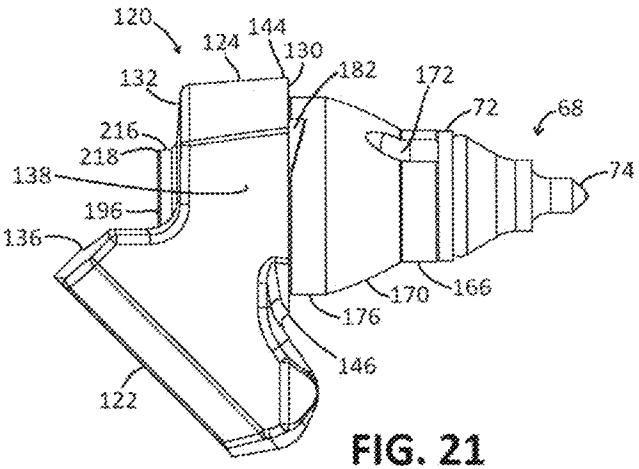
FIG. 21 is a side elevation view of the first embodiment of the bit assembly including the prior art bit mounted in the first embodiment of the bit holder that is mounted in the first embodiment of the base block in accordance with implementations of this disclosure.
Figure 20:
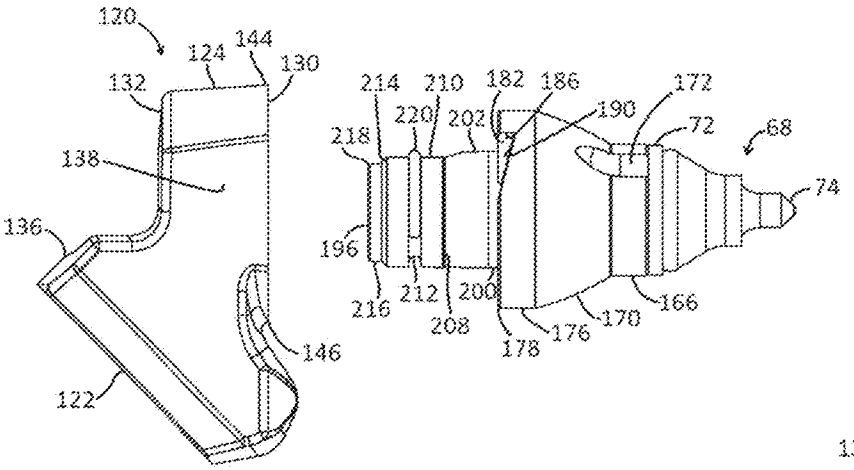
FIG. 20 is an exploded side elevation view of the first embodiment of the bit assembly including the prior art bit mounted in the first embodiment of the bit holder, shown with the first embodiment of the metal ring disposed on the shank of the bit holder, that is mounted in the first embodiment of the base block in accordance with implementations of this disclosure.

To assemble the bit holder 10 in the base block 120, the bit holder shank 14 is inserted into the base block bore 126 such that the slot 54 is radially positioned nearly centrally with the vertical axis of the base block 120. The width of the slot 54 of the shank 14 causes the forward end or nose of the bit holder to droop (downward tilt 150) immediately after the bit holder shank 14 has been mounted in the base block bore 126, also causing the back flange 30 of the bit holder body 12 of the bit holder 10 to be separated from the front face 130 of the device receiving portion 124 of the base block 120, as shown in FIG. 7, and preventing the back flange 30 of the bit holder body 12 from seating onto the front face 90 of the device receiving portion 124 of the base block 120 once the bit holder 10 is fully mounted into the base block bore 126 of the base block 120. The downward tilt 150 of the nose of the bit holder 10 is tied to the width of the slot 54 of the shank 14. The wider the width of the slot 54, the more significant the downward tilt 150 will be. For example, a slot with a ¼ inch width causes the nose of the bit holder to droop causing a downward tilt of about 1/32 inch, whereas a slot with a ⅝ width causes the nose of the bit holder to droop causing a downward tile of about ⅛ inch. Thereafter, the forces generated by impact during use cause further separation of the bottom of the bit holder body 12 from the front face 130 of the device receiving portion 124 of the base block 120, increasing the downward tilt 150 and reducing the lifetime of the bit holder 10, base block 120, and drum. Therefore, a need has developed to prevent the downward tilt of the bit holder and separation of the bottom of the bit holder body from the front face of the device receiving portion of the base block.

Referring to FIGS. 9-11 and 15-27, a first embodiment of a bit holder 160 is shown. The bit holder 160, in this illustrated embodiment, is an approximately 1½ inch shortened length shank bit holder that comprises a "beefed up" bit holder body 162 and a generally cylindrical hollow shank 164 axially depending from a bottom of the bit holder body 162. The shank 164 is generally cylindrical, in this illustrated embodiment, with respect to the centerline of the bit holder 160 and includes an outer surface adjacent a distal end 196 of the shank 164 that comprises a differing radial orientation from the adjacent base block bore 86, 126 of base block 80, 120, respectively.

In other embodiments, the shank can include an arcuate shape, inward taper, an outward taper, a slight draft angle, a slight draw angle, and/or any combination of same as long as the configuration of the shank 164 is differential from the fixed taper of the bore 86, 126 of the base block 80, 120, respectively. This design of the bit holder can also be implemented successfully with various length shanks.

The bit holder body 162, in this exemplary implementation of the first embodiment, is generally annular in shape and comprises a generally cylindrical upper body portion 166 axially extending from a top surface 168, such as a flat annular top surface. Subjacent the upper body portion 166 is an arcuate mediate portion 170 that extends to a generally cylindrical tire portion 176 axially extending from the mediate portion 170, which in this embodiment includes a convex side surface that extends axially, downwardly, and radially outwardly to the generally cylindrical tire portion 176 axially extending from the mediate portion 170. A tapered portion or chamfer 178 (FIGS. 9, 11 and 15-20) extends from a bottom of the tire portion 176 to a back flange 180, which may be flat and generally annular. The tapered portion 178 provides, when the bit holder 160 is fully mounted in the prior art base block 80 or a first embodiment of a base block 120 (FIGS. 6-8, 19-21, and 25-27), a hollowed out area between the back flange 180 of the bit holder body 162 and a face of the base block 120 that provides a space in which an extraction tool (not shown) may be inserted and utilized to easily remove the bit holder 160 from the base block 80, 120. A pair of notches 172, 174, shown in FIGS. 9-11 and 15-21, are formed into the bit holder body 162 and extend from the flat annular top surface 168 through the upper body portion 166, terminating at a point just within the flared mediate portion 170. The notches 172, 174 provide access and leverage for a tool to extract, or knock out, a bit 68 from the bit holder body 162.

The back flange 180 includes a pair of horizontal tapered cutouts 182, 184 (FIGS. 9-11 and 15-21) generally perpendicular to the longitudinal axis of the bit holder 160, one on either side of the back flange 180. The tapered cutouts 182, 184 each include a flat vertical inside surface 186, 188, respectively, parallel with each other and a flat tapered top surface 190, 192, respectively. The outside edge of each top surface 190, 192 is arcuate in shape and follows the periphery of the tire portion 176. The interior border, or declining terminus 228 (FIGS. 10 and 15) of each tapered cutout 182, 184 may extend to a plane through the centerline of the bit holder 160, may not extend to a plane through the centerline of the bit holder 160, may extend beyond a plane through the centerline of the bit holder 160, and/or may be offset from each other. The tapered cutouts 182, 184 are adapted to receive a pair of bifurcated fork tines that may be inserted between the base of the bit holder body 162 and the front face 90, 130 of the prior art base block 80 or the first embodiment of the base block 120, respectively, into which the shank 164 of the bit holder 160 is inserted and retained by outward radial forces of the shank while in use. Other base block configurations can be used without deviating from the concept of this design.

The shank 164 includes an elongate slot 204 extending from a distal end 196, such as a generally annular distal end, of the shank 164 axially upward or forward to an upper termination 206 near the upper or forward end of the shank 164. In other embodiments, the shank 164 can also include an optional internally oriented second slot located approximately 180 degrees around the annular shank 164 from slot 204. This internal slot is parallel to slot 204 and is an internal slot having a rearward termination inwardly adjacent to the distal end 196 of the shank 164 and a forward termination generally coinciding longitudinally and axially with the upper termination 206 of slot 204.

A central bore 194 axially extends from the top surface 168 of the bit holder 160 to the distal end 196 of the shank 164. The central bore 194 is adapted to receive the shank of a bit (not shown). The central bore 194 and the slot 204 allow the generally C-shaped annular sidewall of the shank 164 to radially contract when the shank is mounted into the bore 86 of the base block 80 or a bore 126 of the first embodiment of the base block 120.

Depending from the back flange 180 of the bit holder body 162 is the generally cylindrical hollow shank 164. The top portion of the shank 164 and the bottom of the bit holder body 164 include a rounded junction 198 disposed between the bit holder body 162 and the shank 164 which provides a stress relieving portion between the bit holder body 162 and the shank 164 of the bit holder 160, avoiding sharp corners and/or edges and which may provide an area for stress cracks to begin. An increased diameter first segment 200, which in this illustrated embodiment is generally cylindrical, axially depends from the bottom of the bit holder body 162 and extends towards the distal end 196 adjacent a decreased diameter tapered second segment 202. The decreased diameter tapered second segment 202 axially extends from adjacent the increased diameter first segment 200 to a first tapered portion or annular shoulder 208 disposed between the decreased diameter tapered second segment 202 and an increased diameter outwardly tapered third segment 210. The annular shoulder 208 decreases, or steps down, as it axially extends from the increased diameter first segment 200 to the decreased diameter tapered second segment 202. The increased diameter tapered third segment 210 includes a groove 212 (FIGS. 9-11, 16, 18-21, 23, 24, 26, and 27) adapted to receive an annular ring 220, such as an annular metal ring. Groove 212 includes the same profile seat, or inner diameter, for the bottom portion of the groove 212 as the inner diameter of the annular ring 220. A second tapered portion or stepped shoulder 214 axially extends from the distal end of the increased diameter third segment 212 to a decreased diameter generally cylindrical fourth segment 216. The stepped shoulder 214 decreases, or steps down, as it axially extends from the increased diameter tapered third segment 210 to the decreased diameter generally cylindrical fourth segment 216. A third tapered portion or chamfer 218 axially extends from the distal end of the decreased diameter generally cylindrical fourth segment 216 to the distal end 196 of the shank 164.

In other embodiments, the shank 164 may comprise different configurations, for example, the first segment 200, the second segment 202, the third segment 210, and/or the fourth segment 216 may comprise a generally cylindrical shape, an arcuate shape, an outward taper, an inward taper, a slight draw angle, or a slight draft angle as long as the configuration of the shank 164 is differential from the fixed taper of the bore 86, 126 of the base block 80, 120, respectively. The shank 164 can also be cylindrical or tapered towards or away from a central axis of the bit holder 160 and still have the annular ring concept to achieve the same functional aspects as long as the configuration of the shank 164 is differential from the fixed taper of the bore 86, 126 of the base block 80, 120, respectively.

By reducing the angle of the increased diameter tapered third segment 210 near the end of the shank 164 of the bit holder 160, more force is radially applied by an annular ring, described below, near the distal end 196 of the shank 164, providing a greater differential interference between the annular ring and the base block bore 86, 126 of base block 80, 120, respectively. In this illustrated embodiment, the base block bore 86, 126 includes a fixed one degree taper per side, therefore the shank 164 must have less than a one degree taper per side in order for the annular ring to form a sufficient interference fit to retain the bit holder 160 in the base block bore 86, 126 of the base block 80, 120, respectively. As long as the annular ring disposed around the third segment 210 of the shank 164 has an increased convergence with the base block bore 86, 126 toward the distal end 196, many combinations can be engineered to provide the necessary holding force between the bit holder 160 and the base block 80, 120. For example, a cylindrical base block bore and a shank that includes an outward taper, an inward tapered base block bore and a generally cylindrical shank, an inward tapered base block bore and a shank that includes a less inward taper, an inward tapered base block bore and a shank that includes an outward taper, etc., can create the necessary differential interference fit between the annular ring and the base block bore 86, 126 to retain and maintain the bit holder 160 in the base block 80, 120.

Referring to FIGS. 9-16, 18-21, 23, 24, 26, and 27, a first embodiment of an annular ring 220 is shown. In this illustrated exemplary first embodiment, the annular ring 220 is a metal round ring, including a round cross-section 222 that extends from a first end 224 to a second end 226. The annular ring 220 acts like a bridge across the slot, acting like a solid surface such as a metal beam, and includes a raised profile. The raised profile or outer diameter pf the annular ring 220 is the only contacting surface at the distal end 196 of the shank 164, thereby providing all of the interference, including the bridging effect, that compensates for downward tilt and reducing nearly completely the droop of the nose of the bit holder 160 once assembled into the bore 86, 126 of the base block 80, 120, respectively. In alternate embodiments, the annular ring 220 can have various other shapes, such as square, hexagon, angular, flat, etc. The outer profile of the annular ring 220 of each embodiment matches the base block bore 86, 126 profile.

To assemble the annular ring 220 with the bit holder 160 of the first embodiment, the annular ring 220 is disposed around/in groove 212 of the increased diameter third segment 210, as shown in FIGS. 9-11, 18, 20,23, 24, 26, and 27. When disposed around groove 212, the first end 224 and the second end 226 of annular ring 220 are spatially oriented from each other, in this illustrated embodiment, such that annular ring 220 does not extend completely around the circumference of the shank 164 in groove 212. The annular ring 220 includes an exaggerated raised profile including an outer diameter that is larger than the outer diameter of the shank 164 such that the outer diameter of the shank 164 does not contact the base block bore 86, 126. The outer diameter of the annular ring 220 provides the necessary interference to retain the bit holder 160 in the base block bore 86, 126, compensating for downward tilt 112, 150 and reducing nearly completely the droop of the nose of the bit holder 160. The differential interference provided by the outer diameter of the annular ring 220 against the fixed taper of the base block bore 86, 126, respectively, retains the bit holder 160 in the base block 80, 120.

The shank 164 of the bit holder 160, including annular ring 220, is then inserted into the bore 86, 126 of the base block 80, 120, respectively, such that the increased diameter third segment 210 is positioned in the base block bore 126 adjacent the rear face 132 of the device receiving portion 124 and supports radial deflection. Such deflection is generally in the cut and, as axial forces push back on the bit holder 160, these forces are generally distributed on an outer portion of the tire portion 176 upwardly and to contact the front face 130 of the base block 120 such that there is very minimal deflection.

Generally, base blocks must be replaced before a drum requires replacement. Typically, two sets of base blocks are consumed during the life of a drum. The design described by the present disclosure increases the life of the base block that is welded to the drum, or welded to a riser, which is first welded to the drum that is attached to the machine. The downward tilt of the body 162 of the bit holder 160 prevents nearly 100% contact between the rear annular flange 180 of the bit holder 160 and the front face 90, 130 of the base block 80, 120, respectively. Adding the downward tilt preventing, bore wear compensating annular ring 220 to the groove 212 of the bit holder 160 provides a base block that has almost the same lifespan as the lifespan of the drum on which they're mounted, thereby increasing the lifespan of the drum itself.

Figure 23:
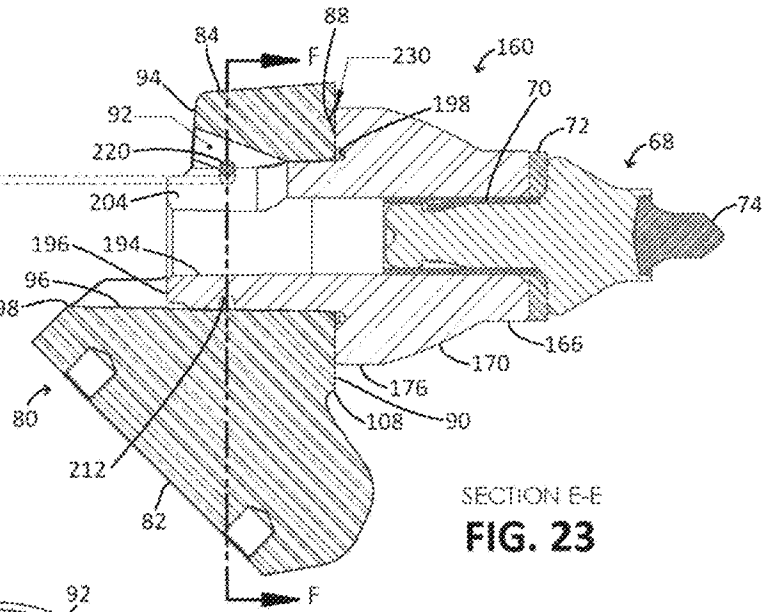
FIG. 23 is a cross-sectional view of the second embodiment of the bit assembly, taken along Line E-E of FIG. 22, showing the prior art bit mounted in the first embodiment of the bit holder, shown with the first embodiment of the metal ring disposed on the shank of the bit holder, that is mounted in the prior art base block in accordance with implementations of this disclosure.
Figure 22:
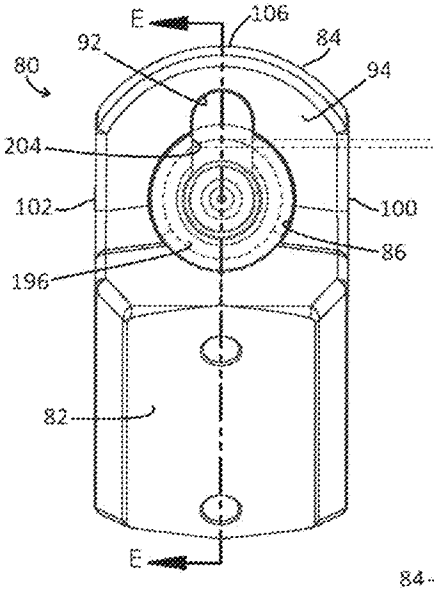
FIG. 22 is a rear elevation view of a second embodiment of a bit assembly including the prior art bit mounted in the first embodiment of the bit holder that is mounted in the prior art base block, showing invisible internal elements in dotted lines, in accordance with implementations of this disclosure.
Figure 24:
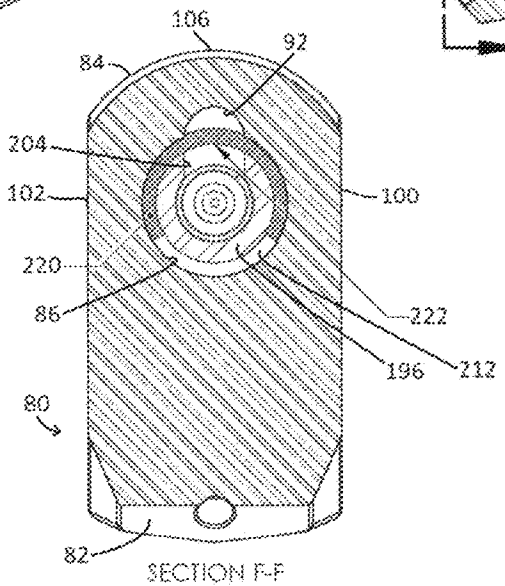
FIG. 24 is a cross-sectional view of the second embodiment of the bit assembly, taken along Line F-F of FIG. 23, showing the prior art bit mounted in the first embodiment of the bit holder, shown with the first embodiment of the metal ring disposed on the shank of the bit holder, that is mounted in the prior art base block, in accordance with implementations of this disclosure.

Referring to FIGS. 22-24, the first embodiment of the bit holder 160, with the first embodiment of annular ring 220 disposed around groove 212 of increased diameter third segment 210, is shown assembled in the bore 86 of the prior art base block 80, such that the rear annular flange 180 of the bit holder 160 contacts the front face 90 of the device receiving portion 84 of the base block 80. When assembled into base block bore 86, the slot 204 in the shank 164 and the annular ring 220 collapse equally or approximately equally, causing the outer diameter of annular ring 220 to become slightly flattened, conforming to almost any similar base block bore diameter, as long as a sufficient interference fit is formed between the bit holder shank 164 and the device receiving portion 84 of base block 80, such that the outer profile of the annular ring 220 matches the bore 86 profile of the base block 80. The increase in the differential interference fit is adjacent the distal end 196 of the shank 164.

The flattened outer surface or diameter of annular ring 220 adds surface area that provides higher load capacity. The angular notch or slot 92 of the device receiving portion 84 allows a pathway for a bit knock-out punch to extract a bit. The annular ring 220, which comprises a wire ring in this illustrated exemplary implementation, can have various configurations. The cross-section 222 of annular ring 220 can be round, square, oval, and/or other shapes. The function of the annular ring 220 is to provide a bridge across the space of the slot 204 in the shank 164, which allows the shank 164 to function as a nearly solid member. The annular ring 220 may be used as formed or it may be heat treated to increase its hardness.

Referring to FIGS. 25-27, the first embodiment of the bit holder 160, with the first embodiment of annular ring 220 disposed around groove 212 of increased diameter third segment 210, is shown assembled in the bore 126 of the first embodiment of the base block 120, such that the rear annular flange 180 of the bit holder 160 contacts the front face 130 of the device receiving portion 124 of the base block 120. When assembled into base block bore 126, the slot 204 in the shank 164 and the annular ring 220 collapse equally or approximately equally, causing the outer diameter of annular ring 220 to become slightly flattened, conforming to almost any similar base block bore diameter, as long as a sufficient interference fit is formed between the annular ring 220 of the bit holder shank 164 and the device receiving portion 124 of base block 120, such that the outer profile of the annular ring 220 matches the bore 126 profile of the base block 120. The increase in the differential interference fit is adjacent the distal end 196 of the shank 164.

The flattened outer surface or diameter of annular ring 220 adds surface area that provides higher load capacity. The angular notch or slot 204 of the device receiving portion 124 allows a pathway for a bit knock-out punch to extract a bit. The annular ring 220, which includes a wire ring in this illustrated exemplary implementation, can have various configurations. The cross-section 222 of annular ring 220 can be round, square, oval, and/or other shapes. The function of the annular ring 220 is to provide a bridge across the space of the slot 204 in the shank 164, which allows the shank 164 to function as a nearly solid member. The annular ring 220 may be used as formed or it may be heat treated to increase its hardness.

In other embodiments, the annular ring can also include a fully or partially circular elastomer ring, such as polytetrafluoroethylene (Teflon), acrylonitrile butadiene rubber (NBR) or nitrile rubber, also known as Buna-N, silicone, etc., that have a sufficient radial strength to withstand the radial forces generated while in use. An example of use of elastomer rings is for smaller equipment with less horsepower that would not require the radial strength of a metal ring.

It is to be understood that while the first embodiment of annular ring 220 was used in groove 212 of shank 164 of bit holder 160, groove 212 of shank 164 of bit holder 160 can accept any variation of annular ring that forms an interference fit with the bore 86, 126 of the base block 80, 120, respectively. The annular ring can be partially or nearly circumferentially disposed around the shank and/or can be up to 259 degrees in circumference.

As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, "X includes at least one of A and B" is intended to mean any of the natural inclusive permutations. That is, if X includes A; X includes B; or X includes both A and B, then "X includes at least one of A and B" is satisfied under any of the foregoing instances. The articles "a" and "an" as used in this application and the appended claims should generally be construed to mean "one or more" unless specified otherwise or clear from context to be directed to a singular form. Moreover, use of the term "an implementation" or "one implementation" throughout is not intended to mean the same embodiment, aspect or implementation unless described as such.

While the present disclosure has been described in connection with certain embodiments and measurements, it is to be understood that the present disclosure is not to be limited to the disclosed embodiments and measurements but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A bit holder adapted to be connected to a base block, the bit holder comprising:

a body portion comprising an annular flange adjacent a bottom of the body portion, the annular flange adapted to contact a front face of the base block;

a generally cylindrical hollow shank axially depending from the bottom of the body portion, the shank comprising:

a slot axially extending from a distal end of the shank;

an annular groove adjacent the distal end of the shank; and a c-shaped annular ring disposed circumferentially in a portion of the annular groove, the c-shaped annular ring adapted to be the only contacting surface with a bore of the base block adjacent the slot and form a differential interference fit with the bore of the base block adjacent the distal end of the shank.

2. The bit holder of claim 1, further comprising:

a forward segment of the shank adjacent the bottom of the body portion, the forward segment comprising a generally cylindrical outer surface.

3. The bit holder of claim 1, further comprising:

a distal segment of the shank adjacent the distal end of the shank comprising the annular groove and an outer surface that is one of tapered radially outwardly as the distal segment axially extends towards the distal end of the shank, tapered radially inwardly as the distal segment axially extends toward the distal end of the shank, and generally cylindrical.

4. The bit holder of claim 1, further comprising:

the slot comprising an upper terminal portion adjacent the bottom of the body portion, the c-shaped annular ring adapted to provide a bridge across the slot allowing the shank to function as a generally solid member.

5. The bit holder of claim 4, the slot comprising a ⅝ inch width adapted to allow up to approximately ⅛ inch of separation between the bottom of the body portion and a front face of a base block in which the shank is mounted.

6. The bit holder of claim 1, further comprising:

a tire portion of the body portion upwardly adjacent the bottom of the body portion, the tire portion comprising a first pair of parallel undercuts extending axially from the bottom of the body portion, the undercuts arcuately spaced apart along the bottom of the body portion, the undercuts being a hollow wedge shape, the undercuts each comprising a declining terminus that at least one of ends short of an axis of the body portion, ends at the axis of the body portion, extends past the axis of the body portion, and is offset from the other declining terminus.

7. The bit holder of claim 6, the tire portion further comprising a radially inward outer annular tapered portion disposed between a distal end of the tire portion and the bottom of the body portion.

8. The bit holder of claim 1, the c-shaped annular ring comprising at least one of a round cross-sectional shape, an angular flat cross-sectional shape, a hexagonal cross-sectional shape, a square cross-sectional shape, a flat cross-sectional shape, a semi-flat cross-sectional shape, an oval cross-sectional shape, and a semi-oval cross-sectional shape.

9. The bit holder of claim 1, further comprising:

a first end of the c-shaped annular ring spaced from a second end of the c-shaped annular ring.

10. The bit holder of claim 1, the c-shaped annular ring comprising one of a steel ring, an elastomer ring, a polytetrafluoroethylene ring, an acrylonitrile butadiene rubber ring, a nitrile rubber ring, and a silicone ring.

11. The bit holder of claim 1, an outer diameter of the c-shaped annular ring being greater than an outer diameter of the shank, the outer diameter of the c-shaped annular ring adapted to contact the bore of the base block.

12. The bit holder of claim 1, wherein an outer diameter of the shank adjacent the distal end of the shank is adapted to be spaced from the bore of the base block.

13. A combination bit holder and base block comprising:

a base block comprising:

a base mounting portion including a base surface; and a device receiving portion integrally extending from the base mounting portion opposite the base surface, the device receiving portion comprising a bore extending from a front face of the device receiving portion to a rear face of the device receiving portion; and a bit holder comprising:

a body portion comprising an annular flange adjacent a bottom of the body portion, the annular flange adapted to contact the front face of the base block;

a generally cylindrical hollow shank axially depending from the bottom of the body portion, the shank comprising:

a slot axially extending from a distal end of the shank;

an annular groove adjacent the distal end of the shank; and a c-shaped annular ring disposed in a portion of the annular groove, the c-shaped annular ring being the only contacting surface with the bore of the of the device receiving portion of the base block adjacent the slot and forming a differential interference fit with the bore of the device receiving portion of the base block adjacent the distal end of the shank.

14. The combination bit holder and base block of claim 13, further comprising:

a forward segment of the shank adjacent the bottom of the body portion, the forward segment comprising a generally cylindrical outer surface.

15. The combination bit holder and base block of claim 13, further comprising:

a distal segment of the shank adjacent the distal end of the shank comprising the annular groove and an outer surface that is one of tapered radially outwardly as the distal segment axially extends towards the distal end of the shank, tapered radially inwardly as the distal segment axially extends towards the distal end of the shank, and generally cylindrical.

16. The combination bit holder and base block of claim 13, further comprising:

the slot comprising an upper terminal portion adjacent the bottom of the body portion, the c-shaped annular ring adapted to provide a bridge across the slot allowing the shank to function as a generally solid member.

17. The combination bit holder and base block of claim 16, the slot comprising a ⅝ inch width allowing up to approximately ⅛ inch of separation between the bottom of the body portion of the bit holder and the front face of the device receiving portion of the base block.

18. The combination bit holder and base block of claim 13, further comprising:

a tire portion of the body portion upwardly adjacent the bottom of the body portion, the tire portion comprising a first pair of parallel undercuts extending axially from the bottom of the body portion, the undercuts arcuately spaced apart along the bottom of the body portion, the undercuts being a hollow wedge shape, the undercuts each comprising a declining terminus that at least one of ends short of an axis of the body portion, ends at the axis of the body portion, extends past the axis of the body portion, and is offset from the other declining terminus.

19. The combination bit holder and base block of claim 18, the tire portion further comprising a radially inward outer annular tapered portion disposed between a distal end of the tire portion and the bottom of the body portion.

20. The combination bit holder and base block of claim 13, the c-shaped annular ring comprising at least one of a round cross-sectional shape, an angular flat cross-sectional shape, a hexagonal cross-sectional shape, a square cross-sectional shape, a flat cross-sectional shape, a semi-flat cross-sectional shape, an oval cross-sectional shape, and a semi-oval cross-sectional shape.

21. The combination bit holder and base block of claim 13, further comprising:

a first end of the c-shaped annular ring spaced from a second end of the c-shaped annular ring.

22. The combination bit holder and base block of claim 13, further comprising:

an extension of an arcuate segment of the bore, the extension extending past the rear face of the device receiving portion and onto a surface of the base mounting portion, the surface of the base mounting portion axially extending from the rear face of the device receiving portion to a rear of the base block.

23. The combination bit holder and base block of claim 13, further comprising:

an angular slot extending axially from the rear face of the device receiving portion, the angular slot enclosed within an outer sidewall of the device receiving portion and the bore, the angular slot decreasing in size from the rear face of the device receiving portion to a position mediate the front face of the device receiving portion and the rear face of the device receiving portion.

24. The combination bit holder and base block of claim 13, the c-shaped annular ring comprising one of a steel ring, an elastomer ring, a polytetrafluoroethylene ring, an acrylonitrile butadiene rubber ring, a nitrile rubber ring, and a silicone ring.

25. The combination bit holder and base block of claim 13, an outer diameter of the c-shaped annular ring being greater than an outer diameter of the shank, the outer diameter of the c-shaped annular ring adapted to contact the bore of the base block.

26. The combination bit holder and base block of claim 13, wherein an outer diameter of the shank adjacent the distal end of the shank is spaced from the bore of the base block.

* * * * *